United States Patent [19]

Wilson

[11] Patent Number: 5,027,914

[45] Date of Patent: Jul. 2, 1991

[54] PILOT CASING MILL

[76] Inventor: Steve B. Wilson, 710 S. Spruce, Vivian, La. 71082

[21] Appl. No.: 533,081

[22] Filed: Jun. 4, 1990

[51] Int. Cl.[5] ..... E21B 10/26; E21B 10/46

[52] U.S. Cl. ..... 175/406; 166/55.6; 175/382; 175/410; 175/413; 407/34; 408/229; 408/232

[58] Field of Search ..... 166/55.6, 55.7; 175/421, 410, 406, 385, 379, 382, 381, 413; 407/34, 41, 56, 57, 58, 61, 62, 80, 103; 408/80, 144, 229, 231, 232, 239 R

[56] References Cited

U.S. PATENT DOCUMENTS

| | | | |
|---|---|---|---|
| 134,805 | 1/1973 | Hipkins, Jr. | 175/382 |
| 1,923,487 | 8/1933 | Howard et al. | 175/421 X |
| 1,932,488 | 10/1933 | Scott | 175/421 X |
| 1,978,084 | 10/1934 | Howard | 175/410 X |
| 3,110,084 | 11/1963 | Kinbach | 166/55.7 X |
| 3,213,716 | 10/1965 | Getts | 408/229 |
| 4,200,159 | 4/1980 | Peschel et al. | 175/329 |
| 4,431,065 | 2/1984 | Andrews | 175/406 X |
| 4,452,325 | 6/1984 | Radd et al. | 175/410 |
| 4,478,296 | 10/1984 | Richman, Jr. | 175/92 |
| 4,511,006 | 4/1985 | Grainger | 175/329 X |
| 4,710,074 | 12/1987 | Springer | 408/200 |
| 4,717,290 | 1/1988 | Reynolds et al. | 407/34 |
| 4,796,709 | 1/1989 | Lynde et al. | 166/55.6 |
| 4,819,703 | 4/1989 | Rice et al. | 407/41 X |

FOREIGN PATENT DOCUMENTS

| | | | |
|---|---|---|---|
| 255742 | 4/1977 | U.S.S.R. | 407/34 |

*Primary Examiner*—Hoang C. Dang

*Attorney, Agent, or Firm*—John M. Harrison

[57] ABSTRACT

A pilot casing mill for removing unwanted pipe from a well bore, which includes a cylindrical pilot having helical vanes and adapted for mounting on one end of a cylindrical mill body. The mill body is provided with longitudinal slots which receive outwardly-extending blades fitted with multiple cutting elements for engaging and cutting the pipe when the pilot casing mill is mounted on the end of a rotatable drill string and inserted in the well. In a preferred embodiment of the invention the blades are removably secured in the slots by removable wedge blocks and may be longitudinally adjusted in place to align adjacent rows of cutting elements, by operation of multiple adjusting screws seated against an adjusting screw ring mounted in a circumferential slot provided in the mill body.

15 Claims, 2 Drawing Sheets

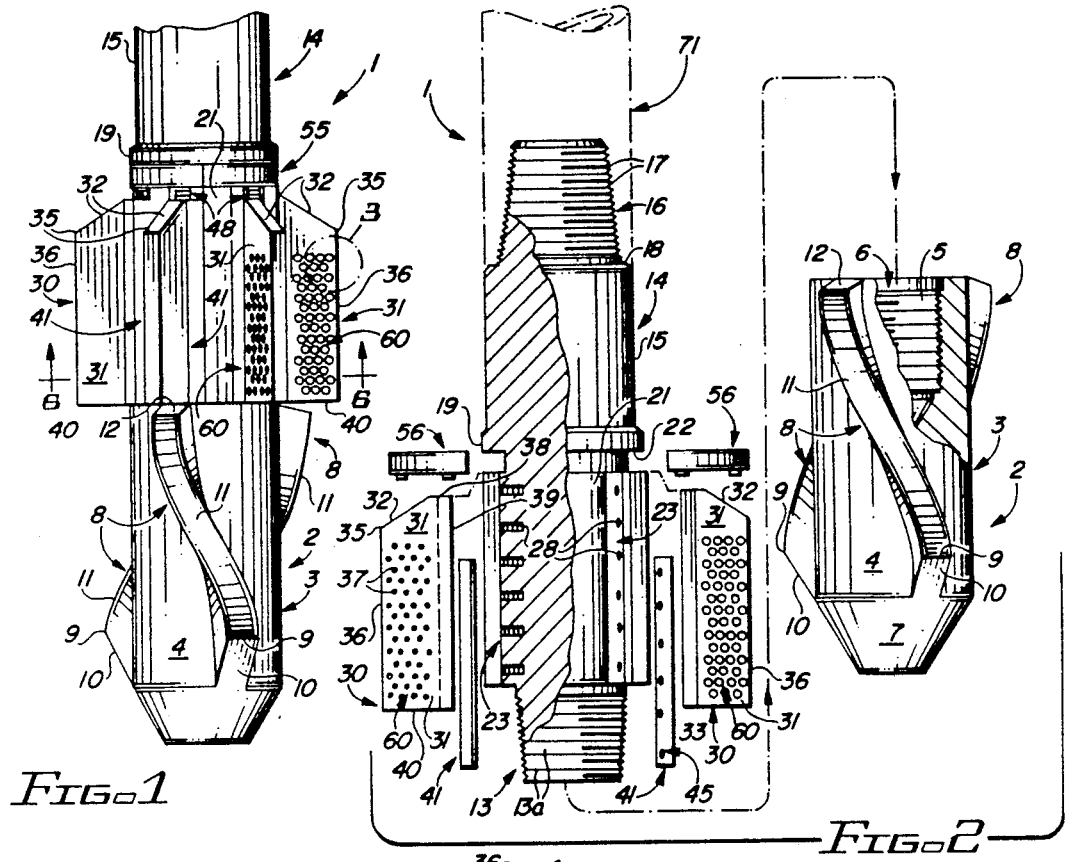
FIG. 1
FIG. 2
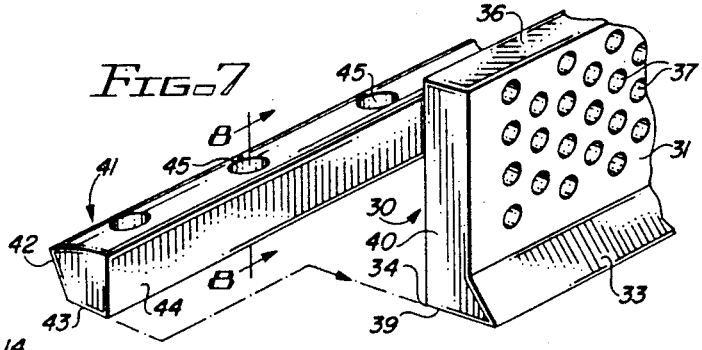
FIG. 7
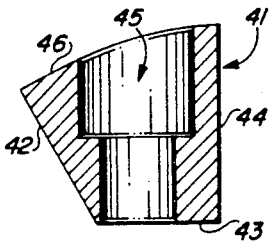
FIG. 8
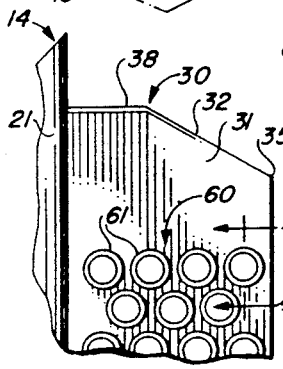
FIG. 3
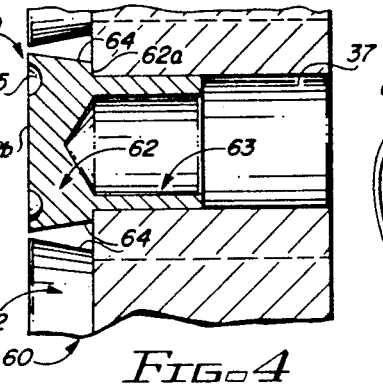
FIG. 4
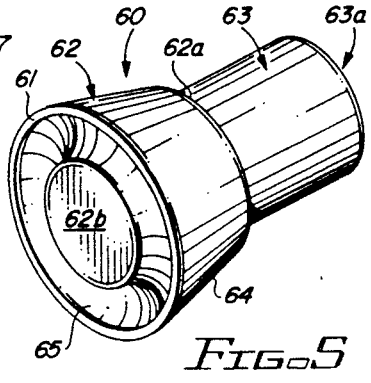
FIG. 5

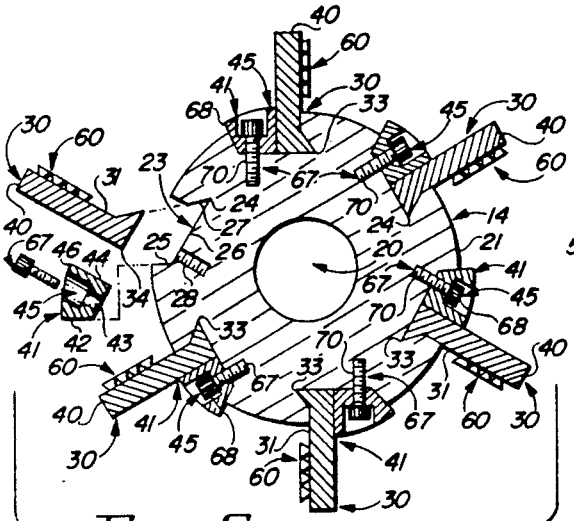
FIG. 6
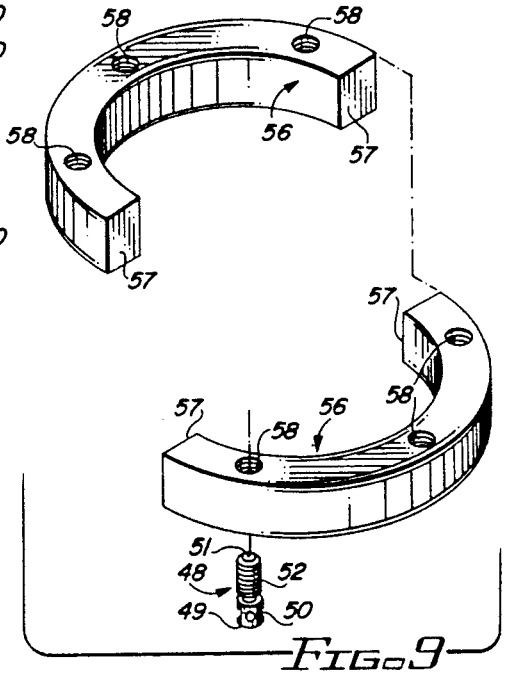
FIG. 9
FIG. 11
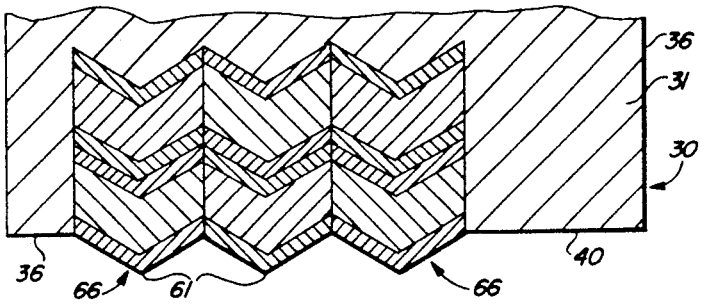
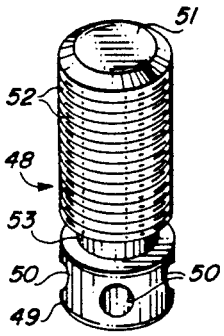
FIG. 10
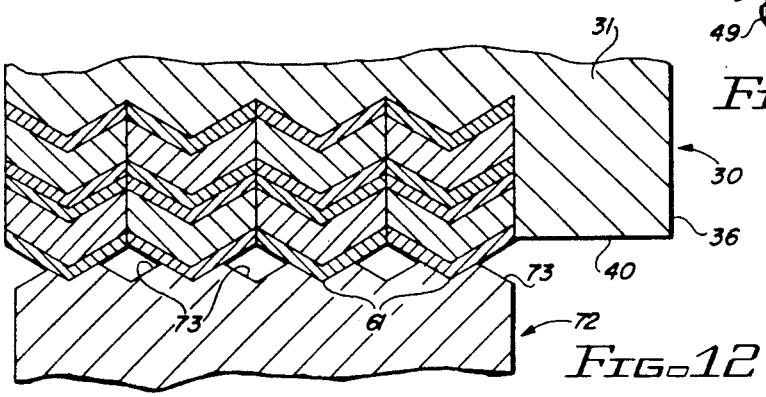
FIG. 12

PILOT CASING MILL

BACKGROUND OF THE INVENTION

1. Field of the Invention

This invention relates to milling tools for removing unwanted pipe such as casing, liners, tubing, drill pipe and the like from the bore hole of an oil, gas or mineral well. More particularly, the invention relates to a pilot casing mill which is characterized by a cylindrical pilot having helical vanes and adapted for mounting on one end of a cylindrical mill body fitted with multiple, removable and adjustable blades, each having multiple cutting elements on one edge thereof. The pilot and mill body are joined by threads and are designed to be extended into the bore hole on the end of a drill string and rotated with the drill string to effect the desired milling operation. In a most preferred embodiment of the invention the blades are removably and longitudinally adjustably mounted in spaced, longitudinal slots provided in the mill body, by means of wedge blocks and multiple cutting elements are mounted in cutting faces of the blades in staggered relationship to maximize cutting efficiency. The cutting elements are designed to seat in openings provided in the blades and to mill shavings, cuttings or "chips" of controlled size from the pipe or casing to be removed from the well bore. Each cutting element includes a shank mounted in one of the openings in the blades and an upper body segment extending from the shank above the blade surface. A cutting edge is provided on the top margin of the upper body segment and in a first preferred embodiment, a chip control groove is located adjacent to the cutting edge of round cutting elements.

The pilot casing mill of this invention is designed to cut the unwanted downhole pipe into "chips" or shavings of controlled size for easy removal by a suitable drilling fluid as the rotating cutting elements engage the pipe and mill it away. These shavings or "chips" are removed from the bore hole of the well by pumping the drilling fluid through the inside of the pilot casing mill, out the bottom of the bore hole and up the annulus of the bore hole to the surface. Lowering and rotation of the pilot casing mill is made possible using a conventional drill stem, column or string of pipe having sufficient length to reach the unwanted downhole pipe or similar obstruction, thus effecting its removal by milling it away. The pilot element of the pilot casing mill serves to centrally locate the cutting elements in the mill body radially around the uppermost end of the pipe or obstruction to be removed. The pilot has an outside diameter which is sized to closely fit the inside of the unwanted pipe, but not so large as to impede rotation or up and down movement of the pilot casing mill in the well bore. The grooves provided in the pilot between the helical vanes permit passage of the drilling fluid from the bottom of the bore hole, up the bore hole, to the surface. The blade elements of the pilot casing mill extend outwardly in radial fashion from the mill body a sufficient distance to insure coverage of the entire face of the downhole pipe to be milled or cut away. Rotation of the drill stem and pilot casing mill may be in either the clockwise or counterclockwise direction, but the device is normally designed for clockwise operation.

2. Description of the Prior Art

Conventional pilot mills are generally characterized by a one-piece construction where vanes are typically welded to the outside of a cylindrical body to form the pilot and blades are welded to the same body above the pilot in spaced, radially-disposed relationship. Cutting elements are then attached to the cutting faces of the blades by glueing, brazing or welding techniques and the tool is secured to a conventional drill stem or string of pipe of sufficient length to reach the unwanted pipe or obstruction and the pipe is milled from the well bore by rotation of the drill string and the pilot mill. In most cases, these cutting elements are composed of crushed cutting grade material combined with nonferrous metal at a temperature sufficiently hot to melt the nonferrous metal, thereby creating a brazing rod impregnated with carbide particles. This composite rod is then attached to the blades to complete the cutting tool. Use of tools having blades prepared in this manner results in an abrading, rather than cutting, of the unwanted downhole pipe or obstruction, and the penetration rate and tool life is therefore highly unpredictable. The resulting cuttings, shavings or "chips" removed from the downhole pipe are of random size and frequently interlock and jam in the well bore on their way to the surface in the drill fluid carrying medium.

Typical of the cutting tools and accessories known in the prior art is the "Composite Structure for Cutting Tools" detailed in U.S. Pat. No. 4,452,325, dated June 5, 1984, to Frederic J. Radd, et al. The structure includes a compact bundle of elongated, substantially cylindrical fibers or rods formed from a cemented metal carbide material. The fiber bundle is shrink-fitted within a metal collar to form a high quality cutting tool structure. A "Casing Mill" is detailed in U.S. Pat. No. 4,710,074, dated Dec. 1, 1987, to J. B. Springer. The casing mill includes a cylindrical body having one end adapted for attachment to a drill string and the other end fitted with pilot vanes which are added to guide the mill with respect to the casing. Multiple blades project outwardly from the body to present a cutting edge for milling casing upon rotation of the mill and polygonal tungsten carbide cutting elements are secured across a forward surface of each blade in a tesselating fashion, each element tilted in the direction of rotation at an angle between 10 and 20 degrees. To mount the cutting elements, the forward surface of the blade may include an inclined stair-step arrangement or inclined slots. Each element is brazed or bonded by a suitable organic adhesive to the forward blade surface. U.S. Pat. No. 4,478,296, dated Oct. 23, 1984, to Charles D. Richmond, Jr., details a "Drill Bit Having Multiple Drill Rod Impact Members". The drill bit is designed for drilling a subterranean bore hole and includes a housing having a cap plate adapted for connection to a drill pipe and a base block axially aligned with and spaced from the cap plate by guide members. Multiple, elongated drill rod impact members are carried by a drill rod holder plate, which is disposed between the cap plate and the base block, for movement longitudinally of the housing. The free ends of the drill rods extend through guide bores in the base block to define exposed working ends for chipping and crushing the formation upon rotation of the drill bit and introducing drilling fluid into the housing in a manner to effect a hammer-like action of the drill rods, which action progressively moves them longitudinally outwardly from the base block as they undergo wear. Each drill rod is preferably constructed in a cylindrical shape and is made harder at its center axis and progressively softer toward its outer periphery, so that the working ends of the drill rods are continually maintained in a generally pointed condition during operation. A "Milling Tool for Cutting Well Casing" is detailed in U.S. Pat. No. 4,796,709, dated Jan. 10, 1989, to Gerald D. Lynde, et al. The milling tool is designed to progressively cut away a section of casing installed within a well from the upper end of the casing. The milling tool includes multiple, elongated blades equally spaced from each other at intervals between one and three inches about the periphery of the cylindrical body of the milling tool. The blades are inclined with respect to the axis of rotation and carbide cutting discs, arranged in horizontal rows on the blades, form the inclined, leading planar face of the blades and the lowermost row of discs forms a cutting edge, with a negative rake engaging the upper end of the casing in the cutting operation.

It is an object of this invention to provide a pilot casing mill having removable and adjustable blades for milling unwanted pipe such as casing, liners, tubing, drill pipe and the like, from the bore hole of an oil and/or mineral well by attachment to a drill string.

Another object of the invention is to provide a pilot casing mill which is characterized by a pilot having helical vanes, a mill body attached to the pilot and multiple removable and adjustable blades mounted in longitudinal slots provided in the mill body for engaging the unwanted pipe and milling the pipe from the bore hole responsive to attachment of the opposite end of the mill body to a drill string and rotating the drill string.

Yet another object is to provide a pilot casing mill fitted with removable and longitudinally-adjustable cutting blades which receive and mount cutting elements in a manner which eliminates the necessity of welding or heat bonding and facilitates use of the cutting elements, which are seated in openings provided in the cutting blades and may be heat-sensitive or cannot be attached by welding or heat bonding techniques.

Still another object of this invention is to provide a new and improved pilot casing mill which is characterized by a pilot having helical vanes thereon for guiding the pilot casing mill into the bore hole of a well, a cylindrically-shaped mill body threaded on the pilot and provided with multiple, radially-spaced and longitudinally-oriented slots for removably mounting longitudinally-adjustable blades having cutting elements which engage the downhole pipe and mill the pipe from the well bore responsive to attachment of the mill body to a drill string and rotating the drill string and pilot casing mill in the bore hole.

Another object of this invention is to provide a pilot casing mill which includes adjustably and removably-mounted cutting blades provided with cutting elements of various design seated in openings arranged in alternating rows on each blade and alternating in sequence from blade-to-blade, to facilitate a more precise positioning of the cutting elements on the blades and greater precision in controlling the cutting element position on leading and following blades and the size of "chips" milled from downhole pipe by the cutting elements.

A still further object of this invention is to provide a new and improved pilot casing mill for milling unwanted pipe such as casing and the like, from the bore hole of a well, which pilot casing mill is characterized by a pilot having helical vanes for guiding the pilot casing mill into the bore hole; an elongated, cylindrically-shaped mill body threadably secured to the pilot and provided with radially-spaced, longitudinally disposed blade slots adapted for receiving removable and longitudinally-adjustable, radially-oriented blades; a split ring mounted in a split ring slot located in the mill body for receiving and threadably mounting multiple adjusting screws seated against the blades, respectively, for adjusting the blades longitudinally with respect to the mill body; and cutting elements seated in openings provided in the cutting face of the blades in staggered relationship for engaging and milling the unwanted pipe from the well bore responsive to attachment of the mill body to a drill string, rotating the drill string and cleanly severing each row of cutting elements from the blades to expose a new row of sharp cutting elements when the used cutting elements are dull.

Yet another object of this invention is to provide a pilot casing mill characterized by a pilot, a mill body attached to the pilot, multiple blades mounted by means of wedge blocks in longitudinal slots provided in the mill body and cutting elements of similar or dissimilar configuration mounted in a selected geometrical arrangement in openings or seats drilled or otherwise provided the cutting faces of the blades, which cutting elements each include a shank for engaging a corresponding seat in the blade and a flared or angulated upper body portion which terminates in a round, chevron or alternatively shaped cutting edge.

SUMMARY OF THE INVENTION

These and other objects of the invention are provided in a new and improved pilot casing mill for removing unwanted downhole pipe such as casing, liners, tubing, drill pipe and the like from a well bore, which pilot casing mill includes a tubular pilot provided with spaced, helical vanes thereon for guiding the pilot casing mill into the bore hole, a cylindrical mill body threaded on one end of the pilot and provided with radially-disposed, spaced, longitudinal slots for receiving multiple blades and wedge blocks removably seated in the slots and bolted in place against the blades for removably and adjustably securing the blades to the mill body. In a preferred embodiment the mill body further includes a circumferential ring groove for threadably receiving a split ring and multiple adjusting screws threaded in the split ring in spaced relationship and contacting the blades, respectively, for longitudinally adjusting and indexing the blades, either in concert or individually, with respect to the mill body and aligning multiple cutting elements, each having a cutting face and a hollow shank weakening feature, the cutting elements disposed in a selected pattern, with the shanks mounted in seats provided on a cutting side or face of each of the blades in staggered relationship for milling the unwanted pipe from the bore hole responsive to attachment of the mill body to a drill string and rotating the drill string and pilot casing mill in the bore hole.

BRIEF DESCRIPTION OF THE DRAWINGS

The invention will be better understood by reference to the accompanying drawings, wherein:

FIG. 1 is a perspective view, partially in section, of a preferred embodiment of the pilot casing mill of this invention;

FIG. 2 is an exploded view of the pilot casing mill illustrated in FIG. 1;

FIG. 3 is an enlarged view of a segment of a cutting blade illustrated in the pilot casing mill of FIG. 1;

FIG. 4 is a sectional view taken along line 4—4 of the enlarged cutting blade segment illustrated in FIG. 3;

FIG. 5 is a perspective view of a preferred round cutting element used in the pilot casing mill of this invention;

FIG. 6 is a sectional view taken along line 6—6 of the mount segment of the pilot casing mill illustrated in FIG. 1;

FIG. 7 is a perspective view, partially in section, of a portion of a cutting blade and wedge block used for mounting the cutting blade in the pilot casing mill illustrated in FIG. 1;

FIG. 8 is a sectional view taken along 8—8 of the wedge block illustrated in FIG. 7;

FIG. 9 is a perspective view of a pair of ring segments of an adjusting screw ring used in the pilot casing mill illustrated in FIG. 1;

FIG. 10 is an enlarged perspective view of an adjusting screw for threadably seating in the ring segments of the adjusting screw ring illustrated in FIG. 9;

FIG. 11 is a side view, partially in section, of alternative chevron cutting elements for mounting on the blades of the pilot casing mill illustrated in FIG. 1; and FIG. 12 is a side view of the chevron cutting elements engaging a downhole pipe in the milling operation.

DESCRIPTION OF THE PREFERRED EMBODIMENTS

Referring initially to FIGS. 1, 2 and 6 of the drawings, the pilot casing mill of this invention is generally illustrated by reference numeral 1. The pilot casing mill 1 includes a cylindrical pilot 2, characterized by a pilot cylinder 3, having a smooth, rounded cylinder surface 4 and an internal cylinder bore 6, provided with internally-located cylinder threads 5, illustrated in FIG. 2, for purposes which will be hereinafter further described. The cylinder bore 6 extends longitudinally through the entire length of the pilot cylinder 3 and the bottom end of the pilot cylinder 3 is provided with a cylinder taper 7. Three helically-shaped vanes 8 are upward-standing from the cylinder surface 4 of the pilot cylinder 3 in spaced relationship and a vane margin 9 is provided in the bottom end of the vanes 8 to define a vane taper segment 10, which extends from the vane margin 9 to the cylinder taper 7. A primary vane segment 11 projects from the vane margin 9 upwardly and terminates in a vane base 12 at the opposite, or top end of the pilot 2. As further illustrated in FIGS. 1 and 2, a cylindrical mill body is generally illustrated by reference numeral 14 and includes a unitary mount segment 15 and blade segment 21, extending beneath the mount segment 15. A pilot mount nipple 13 terminates the bottom end of the blade segment 21 element of the mill body 14 and is fitted with mount nipple threads 13*a* for attachment to the corresponding cylinder threads 5, provided in the cylinder bore 6 of the pilot cylinder 3. A stem nipple 16 terminates the top end of the mount segment 15 and includes nipple threads 17, for attachment to a conventional drill string 71, illustrated in phantom in FIG. 2, to facilitate lowering the pilot casing mill 1 into a well bore {not illustrated) and rotating the pilot casing mill 1 in cutting configuration, as further hereinafter described. A nipple shoulder 18 terminates the stem nipple 16 and seats against the connecting one of the drill pipe in the drill string 71, when the pilot casing mill 1 is coupled to the drill string 71, according to the knowledge of those skilled in the art. A mount segment margin 19 is provided at the bottom end of the mount segment 15 to facilitate shaping of a ring groove 22 of proper depth in the adjacent blade segment 21. A mill body bore 20 is also provided in the mill body 14, as illustrated in FIG. 6, and extends longitudinally through the mount segment 15 and the blade segment 21, in communication with the cylinder bore 6 of the pilot cylinder 3 when the pilot 2 is attached to the mill body 4, as illustrated in FIG. 1. Radially-spaced blade slots 23 are also provided longitudinally in the blade segment 21 of the mill body 14, as further illustrated in FIG. 1.

Referring now to FIGS. 1, 2, 3, 6 and 7 of the drawings, and particularly to FIG. 6, each of the blade slots 23 is shaped to define a slot toe 24, a slot heel 25, located opposite the slot toe 24, a flat slot base 26 extending from the slot toe 24 to the slot heel 25 and a slot shoulder 27, also extending from the slot toe 24. Multiple, spaced, threaded cap screw seats 28 are provided in the slot base 26 of each blade slot 23 in spaced relationship, near the slot heel 25. The blade slots 23 are each designed to receive a corresponding blade 30 having a cutting face 31, a blade bevel 32 at one end thereof, a blade toe 33, extending along one longitudinal edge of the blade 30 and adapted to engage the slot toe 24 of a corresponding blade slot 23, as illustrated in FIG. 6, and a blade heel 34, which lies opposite the blade toe 33. A bevel margin 35 divides the blade bevel 32 from the outside edge 36 of the blade 30, as illustrated in FIG. 3, and cutting element seats 37 are provided in a preferred spacial arrangement in the cutting face 31 of each blade 30, as illustrated in FIG. 7. An adjusting face 38 extends from the opposite end of the blade bevel 32 to the blade base 39, as further illustrated in FIG. 3, which blade base 39 seats against the flat slot base 26 of a corresponding blade slot 23 when each blade 30 is mounted in a corresponding blade slot 23, as illustrated in FIGS. 1 and 2. The blades 30 each terminate at the bottom in a contact edge 40, which initially engages a downhole pipe or obstruction, as hereinafter further described.

As illustrated in FIGS. 1, 2 and 6–8, elongated wedge blocks 41 are designed to be inserted in the blade slots 23, respectively, to wedge each blade 30 in the cutting position illustrated in FIGS. 1 and 6. Each of the wedge blocks 41 is characterized by a wedge block heel 42, which seats against the slot heel 25 of a corresponding blade slot 23, a wedge block base 43, which lies parallel to and slightly spaced from the corresponding slot base 26 of the blade slot 23 when the wedge block 41 is seated in a blade slot 23 and a contact surface 44, which rests against the blade heel 34 of a corresponding blade 30. Each of the wedge blocks 41 further includes a rounded outside surface 46 and a cap screw opening 45, for accessing a cap screw 67, characterized by a cap screw head 68, provided with a hex seat (not illustrated) and a threaded cap screw shank 70, as further illustrated in FIG. 6. The cap screws 67 are designed to be inserted in the respective cap screw openings 45, provided in the wedge blocks 41, and the cap screw shanks 70 threaded into corresponding cap screw seats 28, located in the blade slots 23, for securing the blades 30 in the respective blade slots 23.

Referring now to FIGS. 1, 9 and 10, multiple adjusting screws 48 are each characterized by an adjusting screw head 49, provided with transverse head openings 50, for receiving an adjusting rod (not illustrated) and threadably adjusting the adjusting screws 48, as hereinafter further described. Each adjusting screw 48 is further provided with an adjusting screw shank 51, fitted with shank threads 52 and spaced from the adjusting screw head 49 by means of a shank neck 53. As illustrated in FIG. 9, the split adjusting screw ring 55 is characterized by a pair of semicircular ring segments 56, which are seated in the ring groove 22, provided in the blade segment 21 of the mill body 14, and the end portions 57 of the ring segments 56 are then joined at a pair of welds 59, to define a unitary adjusting screw ring 55. The adjusting screw ring 55 is also fitted with internally threaded, spaced, adjusting screw seats 58, as still further illustrated in FIG. 9. Accordingly, it will be appreciated from a consideration of FIGS. 1, 2 and 9 that the adjusting screw shanks 51 of the respective adjusting screws 48 are threadably inserted in corresponding adjusting screw seats 58, spaced in the adjusting screw ring 55, such that the adjusting screw head 49 of each of the adjusting screws 48 lies adjacent to and contacts a corresponding adjusting face 38 of a blade 30, located in the blade slots 23, respectively. It will be further appreciated that since the blades 30 are slidably mounted in the blade slots 23, when the cap screws 67, extending through the respective cap screw openings 45 located in the wedge blocks 41, are loosened in the cap screw seats 28, the blades 30 may therefore be independently and longitudinally adjusted by inserting an adjusting rod (not illustrated) in the head openings 50 of the respective adjusting screw heads 49 and rotating the adjusting screws 48 in either the clockwise or counterclockwise direction. When the desired blade adjustment is accomplished, the cap screws 67 are tightened to secure the wedge blocks 41 tightly against the blades 30, respectively, such that the wedge block base 43 of each wedge block 41 is slightly spaced from and parallel to the corresponding slot base 26 of a corresponding blade slot 23.

As illustrated in FIGS. 1–7, multiple round cutting elements 60 are tightly wedged into respective cutting element seats 37, illustrated in FIG. 3, located in the cutting face 31 of each of the blades 30. In a most preferred embodiment of the invention the round cutting elements 60 are each characterized by a body portion having a shank 63, for seating in a cutting element seat 37, a bore **63*a*, provided in the shank 63 and an upper body segment 62, separated from the shank 63 by a shoulder 62*a* and terminated at a round cutting edge 61. The cutting edge 61 projects above the plane of the corresponding cutting face 31, while the shank 63 remains tightly wedged in the cutting element seat 37 at the shoulder 62*a*. The upper body segment 62 of the cutting elements 60 is tapered from the shoulder 62*a* to the cutting edge 61, as illustrated in FIG. 5. The round cutting elements 60 also include a flat face 62*b*, bordered by a circular chip control recess or groove 65, as further illustrated in FIG. 5. In a most preferred embodiment of the invention the shanks 63 of the round cutting elements 60 are tightly fitted into the respective cutting element seats 37, which are aligned in staggered rows, as further illustrated in FIGS. 1–3 and 7. Moreover, the spacial arrangement of the cutting element seats 37 and therefore, the round cutting elements 60, positioned in adjacent ones of the blades 30, is numerically different, the first row of round cutting elements 60 being four in number and the next row three in number, as illustrated in FIG. 6. Accordingly, multiple layers and/or rows of cutting elements 60 are mounted and held in abeyance on each blade 30, wherein the bearing or milling contact edges 40 of the blades 30, which are constructed of a softer metal than the round cutting elements 60, will wear away by rotation of the contact edges 40 against the casing or other undesirable pipe located in the well, to ultimately engage the cutting edges 61 of the cutting elements 60, with the downhole pipe. When the cutting edges 61 of the first row of round cutting elements 60 contact the pipe, milling of the pipe is effected and when the cutting edges 61 become dull and can no longer cut effectively, the adjacent rows of round cutting elements 60 are brought to bear on the obstruction and cutting continues, as the dulled round cutting elements 60 break away from the blades 30 and the intervening portion of the softer blades 30 continue to wear. Accordingly, during the cutting process, the round cutting elements 60 fracture or are otherwise detached from the cutting elements seats 37, usually at the respective shoulders 62*a*, which are purposefully preweakened by the bore 63*a*, as the round cutting elements dull and the cutting element seats 37 wear away. This wearing and cutting action is continued until all round cutting elements 60** are worn and displaced from their position or until the cutting task is completed.

In a most preferred embodiment of the invention and referring again to FIG. 5, each of the round cutting elements 60 is fitted with a chip control recess or groove 65, which lies adjacent to the cutting edge 61, for controlling "chip" size in the cutting action. The weakening feature of the round cutting element 60 is enhanced, in that the upper body segment 62 tapers inwardly from the cutting edge 61, to the shoulder **62*a* and facilitates controlled destruction of the round cutting elements 60 as they wear and the attrition pressure builds to a specified point. The peripheral chip control groove 65 operates to permit flushing away of the cut material to insure that the cutting elements 60 located on the following blade 30** does not come into contact with the material already cut, thereby causing the cutting action to cease or "chips" of unmanageable size or shape to be created.

As further illustrated in FIGS. 6 and 7, the cutting elements 60 are arranged in the cutting element seats 37 of the cutting face 31 of each blade 30 in a manner such that sharing of the cutting action is effected by corresponding indexed rows or layers of the round cutting elements 60, applied at any given point in time to the downhole casing or pipe to be milled. This arrangement must not be random and must be designed to compliment the arrangement of the round cutting elements 60 on the leading blade 30. If this is not effected, uncut material will wedge between the round cutting elements 60 located on a following blade 30 and cutting efficiency will be impaired.

Referring now to FIGS. 11 and 12 of the drawings, in an alternative preferred embodiment of the invention, chevron cutting elements 66 are mounted in the respective cutting element seats 37 in staggered cutting configuration. Each of the chevron cutting elements 66 are characterized by a cutting edge 61 and a shank (not illustrated) for mounting the chevron cutting elements 66 in the cutting element seats 37, respectively, in the same manner as the round cutting elements 60.

In operation and referring again to the drawings, and particularly to FIG. 12, the pilot casing mill of this invention is utilized as follows: The pilot casing mill 1 is first attached to a conventional drill string 71 at the stem nipple 16, as illustrated in FIG. 2, and is then lowered into a well bore (not illustrated) until the contact edge 40 of each of the blades 30 engages a downhole pipe 72 to be cut. Rotation of the supporting drill string 71 and circulation of drill fluid (not illustrated) is then initiated. The desired rotational velocity of the drill string 71 and the pilot casing mill 1 will be determined by the strength and hardness of the downhole pipe 72 being milled or cut. The drilling fluid must be of sufficient consistency to permit the removal of the produced "chips" (not illustrated), according to the knowledge of those skilled in the art. A milling rate sufficient to cause the pilot casing mill 1 to advance into the downhole pipe 72 at a rate from about 0.003 to about 0.005 inch per revolution, multiplied by the number of blades 30 used, is then established, to cut the respective grooves 73. If a safety margin has been provided on the lowermost or contact edges 40 of the blades 30 to permit "tagging" of the downhole pipe 72, this margin will quickly be worn away at an angle corresponding to the helical path described by the pilot casing mill in its forward motion. This angled attrition will create the necessary clearance under the chevron cutting elements 66 or round cutting elements 60 and if this clearance was pre-existant, cutting will begin immediately. The milling of desired thin, short shavings or "chips" from the obstructing downhole pipe 72 will continue until the cutting edges 61 of the lead row of chevron cutting elements 66 or round cutting elements 60 have been dulled and the tool starts to "take weight". Weight on the pilot casing mill 1 results from the resistance of the downhole pipe 72 to the cutting action and this weight should be noted at the beginning of each cutting cycle. If the pilot casing mill 1 starts to require more weight to maintain the cutting rate, this indicates that the cutting edges 61 have become dull and it is time to advance the next row of chevron cutting elements 66 or round cutting elements 60 into contact with the downhole pipe 72. This is accomplished by permitting the weight to build to the point where the leading chevron cutting elements 66 or round cutting elements 60 are fractured and separated from the blades 30. An alternative way of separating these weakened chevron cutting elements 66 or round cutting elements 60 from the blades 30, is to arrest rotation of the drill string 71, raise the drill string 71 to disengage the pilot casing mill 1 from the unwanted downhole pipe 72 being milled and subsequently dropping the drill string 71 and pilot casing mill 1 with sufficient force to shatter the leading row of chevron cutting elements 66 or round cutting elements 60. Either of these methods will accomplish the task; however, the latter technique is preferred, since this action is not dependent upon the tensile strength or fracturing nature of the material used in the chevron cutting elements 66 or round cutting elements 60. Rotation and desirable penetration is thereby restored as the next row of chevron cutting elements 66 or round cutting elements 60 is presented, with new cutting edges 61 bearing on the obstruction, to continue the milling operation. This process is continued with the wearing away of the soft, metal margins between the layers of the chevron cutting elements 66 or round cutting elements 60 also continuing, until the next layer of cutting edges 61 is exposed.

It will be appreciated by those skilled in the art that while both round cutting elements 66 and chevron cutting elements 66 are illustrated in the drawing: and discussed herein for use with the pilot casing mill 1 of this invention, cutting elements having upper body segments and cutting edges of different shape may also be utilized. The key design factors which all of the cutting elements have in common is a shank 63, preferably having a bore **63*a* to create the desired preweakening feature, and tightly seated in a cutting element: seat 37, provided in a blade 30**.

Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A pilot casing mill for milling an obstruction from a well bore comprising body means having one end adapted for connection to a drill string for rotation therewith and pilot means provided on the opposite end of said body means for guiding said body means into the well bore in alignment with the obstruction; a plurality of blades projecting outwardly from said body means, each of said blades having a cutting surface facing in the direction of rotation and a contact edge for engaging the obstruction; a plurality of cutting element seats arranged in successive rows in said contact surface and staggered in spaced relationship from said contact edge of said blades, respectively, a plurality of cutting elements, each having a shank mounted in said cutting element seats, respectively, wherein the number of said cutting elements on adjacent ones of said blades is different in aligned ones of said successive rows, a shoulder provided in said shank for engaging said cutting surface, a bore provided in said shank and a cutting edge extending from said shank for engaging and cutting the obstruction responsive to rotation of the drill string and said body means.

2. The pilot casing mill of claim 1 further comprising a plurality of longitudinal slots provided in said body means for receiving said blades and wedge means adapted for seating in said longitudinal slots against said blades for removably and adjustably mounting said blades in said longitudinal slots.

3. The pilot casing mill of claim 2 further comprising a circumferential groove provided in said body means in spaced relationship with respect to one end of said longitudinal slots, a ring seated in said groove and adjusting means adjustably mounted in spaced relationship in said ring, wherein said adjusting means engage one end of said blades, respectively, for selectively adjusting said blades longitudinally in said longitudinal slots.

4. The pilot casing mill of claim 1 wherein said pilot means further comprises a cylindrical member, a taper provided on one end of said cylindrical member and helical vanes extending from said taper to the opposite end of said cylindrical member.

5. The pilot casing mill of claim 4 further comprising:

(a) a plurality of longitudinal slots provided in said cylindrical body for receiving said blades and wedge means adapted for seating in said longitudinal slots against said blades for removably and adjustably mounting said blades in said slots; and (b) a circumferential groove provided in said body means in spaced relationship with respect to one end of said longitudinal slots, a ring seated in said groove and adjusting means threadably mounted in spaced relationship in said ring, wherein said adjusting means engage one end of said blades, respectively, for selectively adjusting said blades longitudinally in said longitudinal slots.

6. A pilot casing mill for milling a pipe from a well bore, comprising a cylindrical body having one end adapted for connection to a drill string for rotation therewith and pilot means provided on the opposite end of said cylindrical body for guiding said cylindrical body into the well bore in alignment with the pipe; a longitudinal body bore provided in said cylindrical body and a longitudinal pilot bore provided in said pilot means, said body bore communicating with said pilot bore; plurality of slots longitudinally disposed in said cylindrical body in spaced relationship; a plurality of blades projecting outwardly from said body and slidably seated in said slots, respectively, each of said blades having a cutting surface facing in the direction of rotation of said cylindrical body and a contact edge provided at the bottom end thereof for engaging the pipe; wedge means adapted for seating in said slots against said blades for removably and adjustably mounting said blades in said slots; adjusting means provided in said cylindrical body for slidably adjusting said blades longitudinally in said slots; a plurality of cutting element seats provided in said cutting surface in a selected geometric pattern; and a plurality of cutting elements, each comprising a shank mounted in said cutting element seats and a cutting edge extending from said shank for engaging and cutting the pipe responsive to rotation of the drill string and said cylindrical body.

7. The pilot casing mill of claim 6 wherein each of said wedge means further comprises an elongated wedge block having a wedge block contact surface for engaging and seating said blade, a wedge block heel for engaging said slot, a plurality of spaced openings extending transversely through said wedge block and fastening means extending into said spaced openings and removably securing said wedge blocks in said slot.

8. The pilot casing mill of claim 6 wherein said adjusting means further comprises a circumferential groove provided in said cylindrical body in spaced relationship with respect to one end of said longitudinal slots, a ring seated in said groove and adjusting means adjustably mounted in spaced relationship in said ring, wherein said adjusting means engage one end of said blades. respectively, for selectively adjusting said blades longitudinally in said longitudinal slots.

9. The pilot casing mill of claim 8 wherein said wedge means further comprises an elongated wedge block having a wedge block contact surface for engaging and seating said blade, a wedge block heel for engaging said slot, a plurality of spaced openings extending transversely through said wedge block and fastening means extending into said spaced openings and removably securing said wedge blocks in said slot.

10. The pilot casing mill of claim 6 wherein said selected geometric pattern further comprises a staggered geometric pattern wherein said cutting elements are arranged in successive rows staggered in spaced relationship from said contact edge of said blades, respectively, and the number of said cutting elements on adjacent ones of said blades is different in aligned ones of said successive rows.

11. The pilot casing mill of claim 6 wherein:

(a) said wedge means further comprises an elongated wedge block having a wedge block contact surface for engaging and seating said blade, a wedge block heel for engaging said slot, a plurality of spaced openings extending transversely through said wedge block and fastening means extending into said spaced openings and removably securing said wedge blocks in said slot; and said adjusting means further comprises a circumferential groove provided in said cylindrical body in spaced relationship with respect to one end of said longitudinal slots, a ring seated in said groove and adjusting means adjustably mounted in spaced relationship in said ring, wherein said adjusting means engage one end of said blades, respectively, for selectively adjusting said blades longitudinally in said longitudinal slots.

12. The pilot casing mill of claim 11 wherein said pilot means further comprises a cylindrical member, a taper provided on one end of said cylindrical member and helical vanes extending from said taper to the opposite end of said cylindrical member.

13. The pilot casing mill of claim 12 wherein said cutting elements each further comprise a bore extending through said shank and a shoulder provided in said shank for engaging said cutting surface and a body taper expanding outwardly from said shoulder to said cutting edge.

14. The pilot casing mill of claim 12 wherein said cutting elements each further comprise a bore extending through said shank and a shoulder provided in said shank for engaging said cutting surface and a chevron body member extending outwardly from said shoulder to define said cutting edge.

15. A pilot casing mill for milling a pipe from a well bore, comprising a cylindrical body having one end adapted for connection to a drill string for rotation therewith and a pilot provided on the opposite end of said cylindrical body for guiding said cylindrical body into the well bore in alignment with the pipe; a longitudinal body bore provided in said cylindrical body and a longitudinal pilot bore provided in said pilot means, said body bore communicating with said pilot bore; a plurality of slots longitudinally disposed in said cylindrical body in spaced relationship; a plurality of blades projecting outwardly from said body and slidably seated in said slots, respectively, each blade having a cutting surface facing in the direction of rotation of said cylindrical body and a contact edge provided at the bottom end thereof, for engaging the pipe; elongated wedges adapted for seating in said slots against said blades for removably and adjustably mounting said blades in said slots; a plurality of cutting element seats provided in said cutting surface in a selected geometric pattern; adjusting means provided in said cylindrical body for slidably adjusting said blades longitudinally in said slots; and a plurality of cutting elements, each further comprising a shank mounted in said cutting element seats and a cutting edge extending from said shank for engaging and cutting the pipe responsive to rotation of the drill string and said cylindrical body.

* * * * *